US009388605B2

(12) United States Patent
Chen

(10) Patent No.: US 9,388,605 B2
(45) Date of Patent: Jul. 12, 2016

(54) ELECTRONIC LOCK

(71) Applicant: Jie-Fu Chen, Chiayi (TW)

(72) Inventor: Jie-Fu Chen, Chiayi (TW)

( * ) Notice: Subject to any disclaimer, the term of this patent is extended or adjusted under 35 U.S.C. 154(b) by 376 days.

(21) Appl. No.: 14/150,040

(22) Filed: Jan. 8, 2014

(65) Prior Publication Data

US 2015/0191936 A1 Jul. 9, 2015

(51) Int. Cl.
*E05B 47/00* (2006.01)
*E05B 47/02* (2006.01)

(52) U.S. Cl.
CPC ..... *E05B 47/0012* (2013.01); *E05B 47/026* (2013.01); *E05B 2047/002* (2013.01); *E05B 2047/0054* (2013.01); *E05B 2047/0067* (2013.01); *Y10T 292/57* (2015.04)

(58) Field of Classification Search
CPC ... E05B 47/00; E05B 47/0004; E05B 47/026; E05B 47/0012; E05C 9/12; Y10T 292/57
USPC ..... 292/137, 142, 144, 279, 347, 57; 70/271, 275, 277, 278.1, 278.7, 279.1
See application file for complete search history.

(56) References Cited

U.S. PATENT DOCUMENTS 5,199,288 A * 4/1993 Merilainen et al. . E05B 47/0012 292/144
6,334,636 B1 * 1/2002 Huang et al. ..... E05B 47/0012 292/138
6,786,070 B1 * 9/2004 Dimig et al. ..... E05B 77/30 292/201
2001/0029760 A1 * 10/2001 Viney ..... E05B 47/0012 70/279.1
2005/0206499 A1 * 9/2005 Fisher ..... E05B 19/0005 340/5.73
2005/0207087 A1 * 9/2005 Fisher et al. ..... E05B 19/0005 361/160
2010/0257906 A1 * 10/2010 Sorensen et al. ..... E05B 47/068 70/91
2011/0067464 A1 * 3/2011 Chiou et al. ..... E05B 47/0012 70/278.7
2011/0259059 A1 * 10/2011 Wu et al. ..... E05B 47/0012 70/91
2013/0192317 A1 * 8/2013 Mckibben et al. .. E05B 47/0001 70/278.1

* cited by examiner

*Primary Examiner* — James O Hansen
(74) *Attorney, Agent, or Firm* — Alan D. Kamrath; Kamrath IP Lawfirm, P.A.

(57) ABSTRACT

An electronic lock contains a housing including an accommodating chamber, and the accommodating chamber having a central controlling unit, a first connecting member and a second connecting member; a driving motor including a threaded rod; a driving gear including a through aperture, a plurality of first teeth, and a toothed block; a first driven gear including a first opening and a first detected portion; a second driven gear including a second opening and a second detected portion. The electronic lock also contains a first photo interrupter including a first seat, a first light transmitting portion, and a first light receiving portion; a second photo interrupter including a second seat, a second light transmitting portion and a second light receiving portion; and a rotary knob including a grip portion, an stem extending outwardly from the grip portion, and a cross pore defined on a distal end of the stem.

4 Claims, 4 Drawing Sheets

ELECTRONIC LOCK

BACKGROUND OF THE INVENTION

1. Field of the Invention

The present invention relates to an electronic look which compensates unreached distances of a first driven gear and a second driven gear to a first destination position and a second destination position.

2. Description of the Prior Art

Conventional electronic lock contains a rotary knob and a grip portion, the grip portion has a stem, and the stem has a cross orifice defined on a distal end thereof so as to insert into a locking head so that the locking head expandably or retractably unlocks or locks the electronic lock; a motor including a shaft connecting with a driving gear; a transmission gear having a column mounted at a central portion thereof and coupled with the stem of the grip portion, wherein the transmission gear has a toothed surface arranged around an outer rim thereof and meshing with the driving gear, and the transmission gear having a protrusion extending outwardly from a bottom end thereof, such that the transmission gear drives the protrusion to move leftward or rightward so as to drive a first touching portion or a second touching portion after the transmission gear rotates.

However, when the motor rotates forward or reversely, it cannot contact the first touch portion or the second touch portion firmly, so the stem cannot move to a destination position exactly when the transmission gear rotates, and the first touch portion or the second touch portion is worn easily, thus lowering service life.

The present invention has arisen to mitigate and/or obviate the afore-described disadvantages.

SUMMARY OF THE INVENTION

The primary object of the present invention is to provide an electronic look which is capable of overcoming the shortcomings of the conventional electronic look.

To obtain the above objectives, an electronic look provided by the present invention contains: a housing, a driving motor, a driving gear, a first driven gear, a second driven gear, a first photo interrupter, a second photo interrupter, and a rotary knob.

The housing includes an accommodating chamber, and the accommodating chamber has a central controlling unit disposed at a first predetermined position thereof and being adjacent to a power supply, the accommodating chamber also has a first connecting member and a second connecting member mounted on a third predetermined position and a fourth predetermined position thereof, wherein the first connecting member has at least one first hole, the second connecting member has at least one second hole, and a guiding member is fixed in the accommodating chamber proximate to the first connecting member and the second connecting member and has an orifice defined at a central position thereof, a shaft is secured in the accommodating chamber adjacent to the guiding member, and a motor mount is disposed in the accommodating chamber proximate to the shaft.

The driving motor is fixed in the motor mount of the housing and includes a threaded rod mounted on one end thereof.

The driving gear includes a through aperture formed at a central position thereof, a plurality of first teeth arranged around an outer rim thereof, and a toothed block secured at a central position of a bottom end thereof, wherein the through aperture fits with the shaft of the housing, and the plurality of first teeth are driven by the threaded rod of the driving motor.

The first driven gear includes a first opening and a first detected portion, wherein the first opening and the orifice are located in the guiding member of the housing, and the first detected portion has a plurality of transparent zones of varying diameter and width successively arranged around an end surface of the first driven gear which meshes with the toothed block of the driving gear.

The second driven gear includes a second opening and a second detected portion, wherein the second opening is fixed in an upper section of the guiding member of the housing, and the second detected portion has a plurality of transparent zones of varying diameter and width successively arranged around an end surface of the second driven gear.

The first photo interrupter includes a first seat, a first light transmitting portion and a first light receiving portion which extend outwardly from two sides of the first seat, a first transistor connecting with one side of the first seat and having a first transmission line which couples with the central controlling unit, and the first photo interrupter also includes at least two first coupling pins secured on at least two predetermined positions thereof, and the at least two first coupling pins are positioned in the at least one first hole of the housing so that the first light transmitting portion and the first light receiving portion are aligned with the second detected portion of the second driven gear.

The second photo interrupter includes a second seat, a second light transmitting portion and a second light receiving portion which extend outwardly from two sides of the second seat, a second transistor connecting with one side of the second seat and having a second transmission line which couples with the central controlling unit, and the second photo interrupter also includes at least two second coupling pins secured on at least two predetermined positions thereof, and the at least two second coupling pins are positioned in the at least one second hole of the housing so that the second light transmitting portion and the second light receiving portion are aligned with the first detected portion of the first driven gear.

The rotary knob includes a grip portion, a stem extending outwardly from the grip portion, and a cross pore defined on a distal end of the stem such that the stem of the rotary knob inserts and rotates into the first opening and the orifice of the housing so that the grip portion stops an outer wall of the housing.

Thereby, the first light transmitting portion and the first light receiving portion of the first photo interrupter optically scan the plural fourth transparent zones, the plural fifth transparent zones and the plural sixth transparent zones which form the plurality of transparent zones of varying diameter and width successively arranged around the end surface of the first driven gear so that the first transistor of the first photo interrupter accurately judges the rotating position of the second driven gear, and the second light transmitting portion and the second light receiving portion of the second photo interrupter optically scan the plural first transparent zones, the plural second transparent zones, and the plural third transparent zones which form the plurality of transparent zones of varying diameter and width successively around the end surface of the first driven gear so that the second transistor of the second photo interrupter accurately judges the rotating position of the first driven gear. Thereby, the central controlling unit controls the first driven gear and the second driven gear to axially rotate so as to compensate unreached distances of the first driven gear and the second driven gear to the first destination position and the second destination position, hence the locking head rotates forward and reversely.

DETAILED DESCRIPTION OF THE PREFERRED EMBODIMENTS

The present invention will be clearer from the following description when viewed together with the accompanying drawings, which show, for purpose of illustrations only, a first embodiment in accordance with the present invention.

Figure 1:
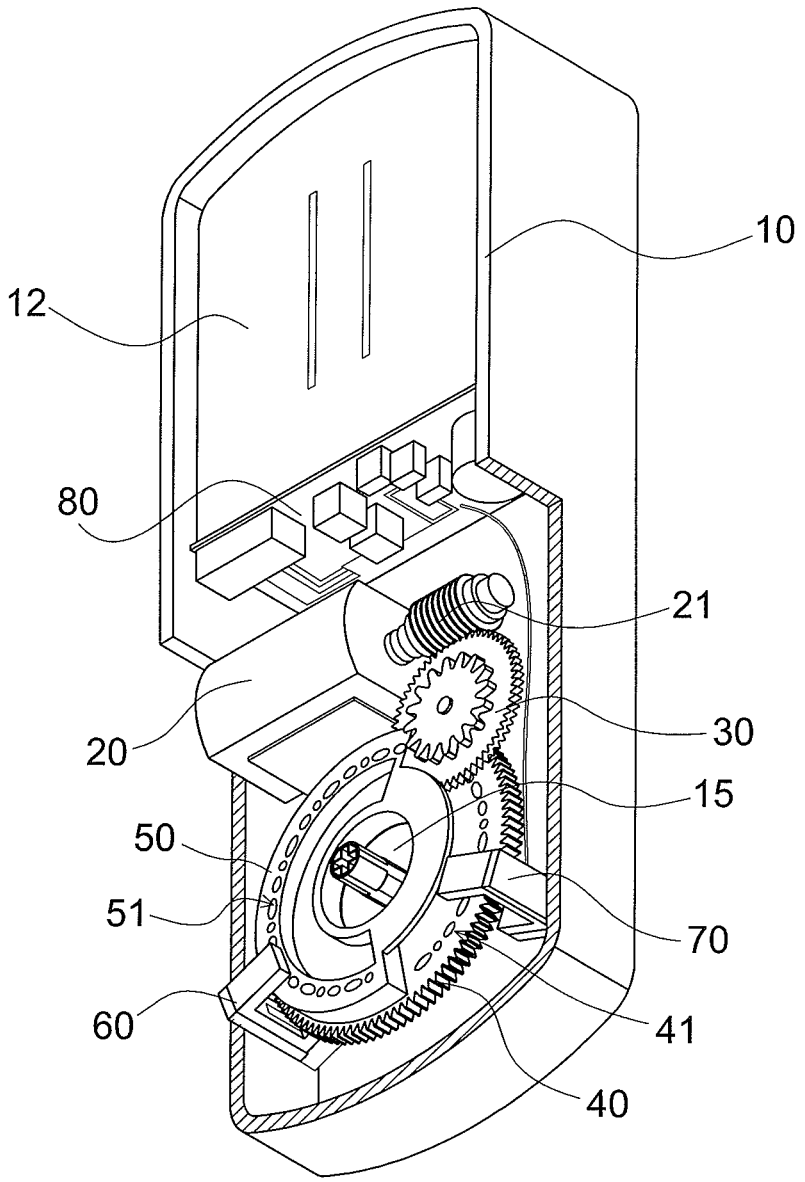
FIG. 1 is a perspective view showing the assembly of an electronic look according to a preferred embodiment of the present invention.
Figure 2:
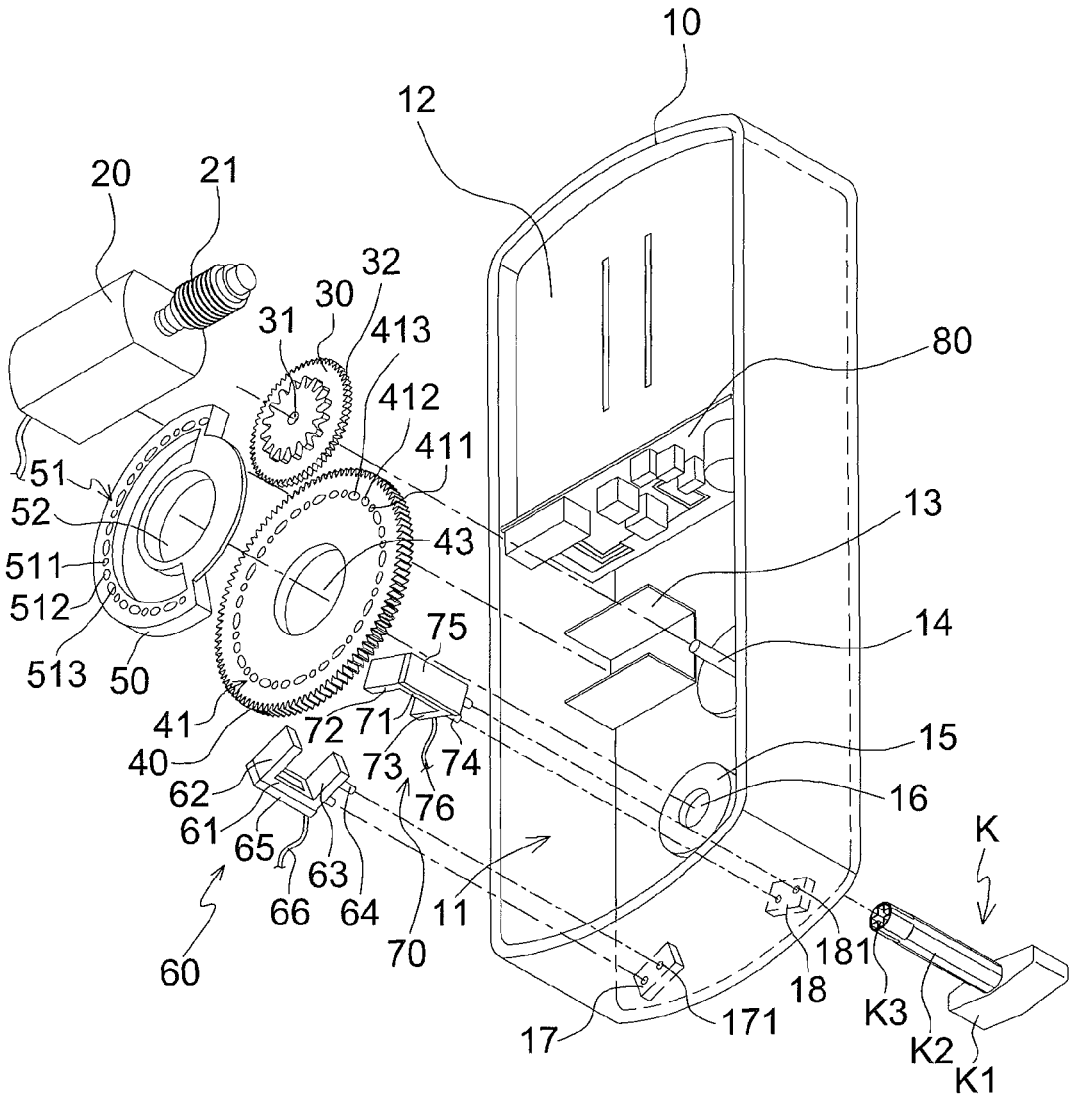
FIG. 2 is a perspective view showing the exploded components of the electronic look according to the preferred embodiment of the present invention.
Figure 3:
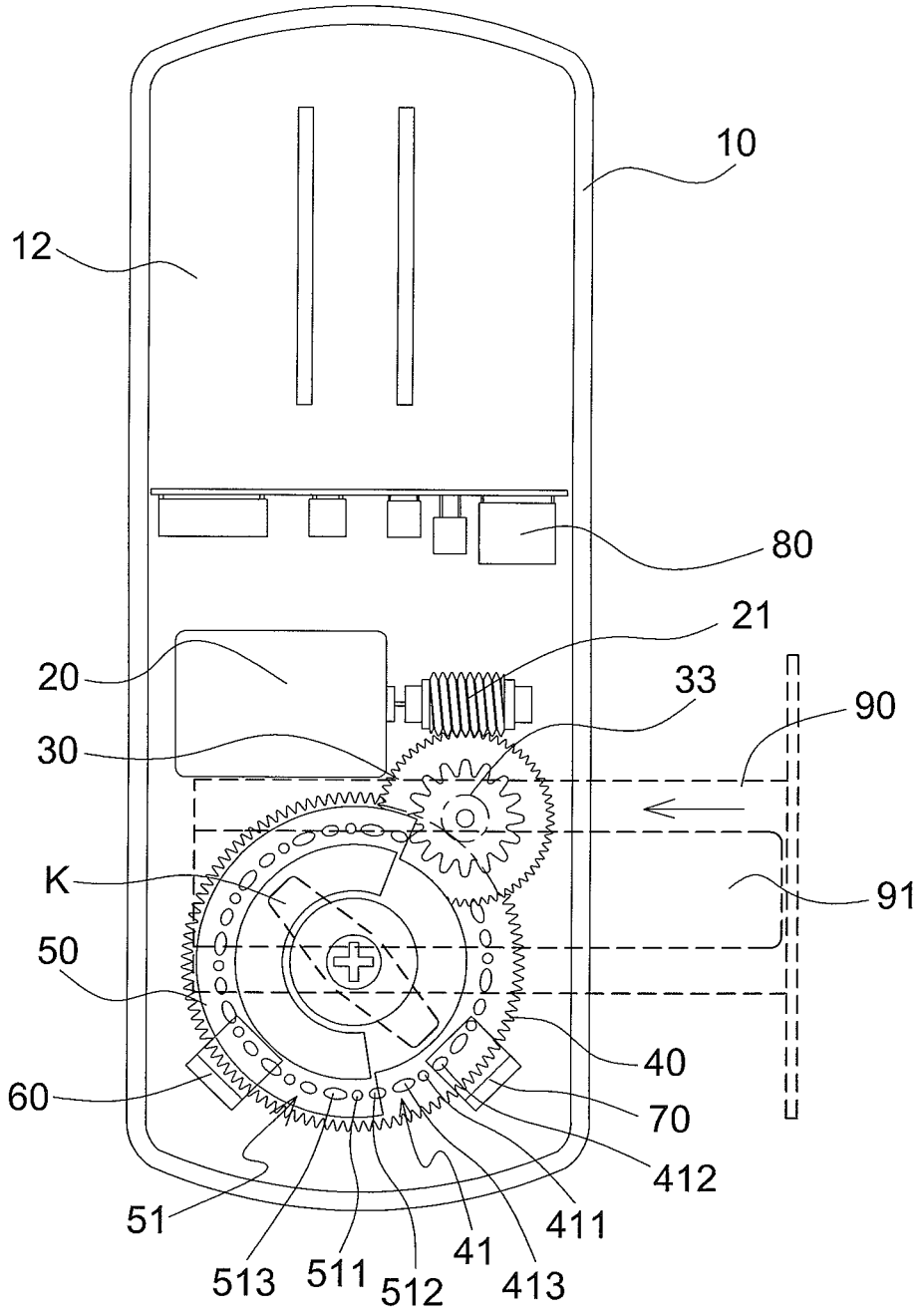
FIG. 3 is a plan view showing the application of the electronic look according to the preferred embodiment of the present invention.
Figure 4:
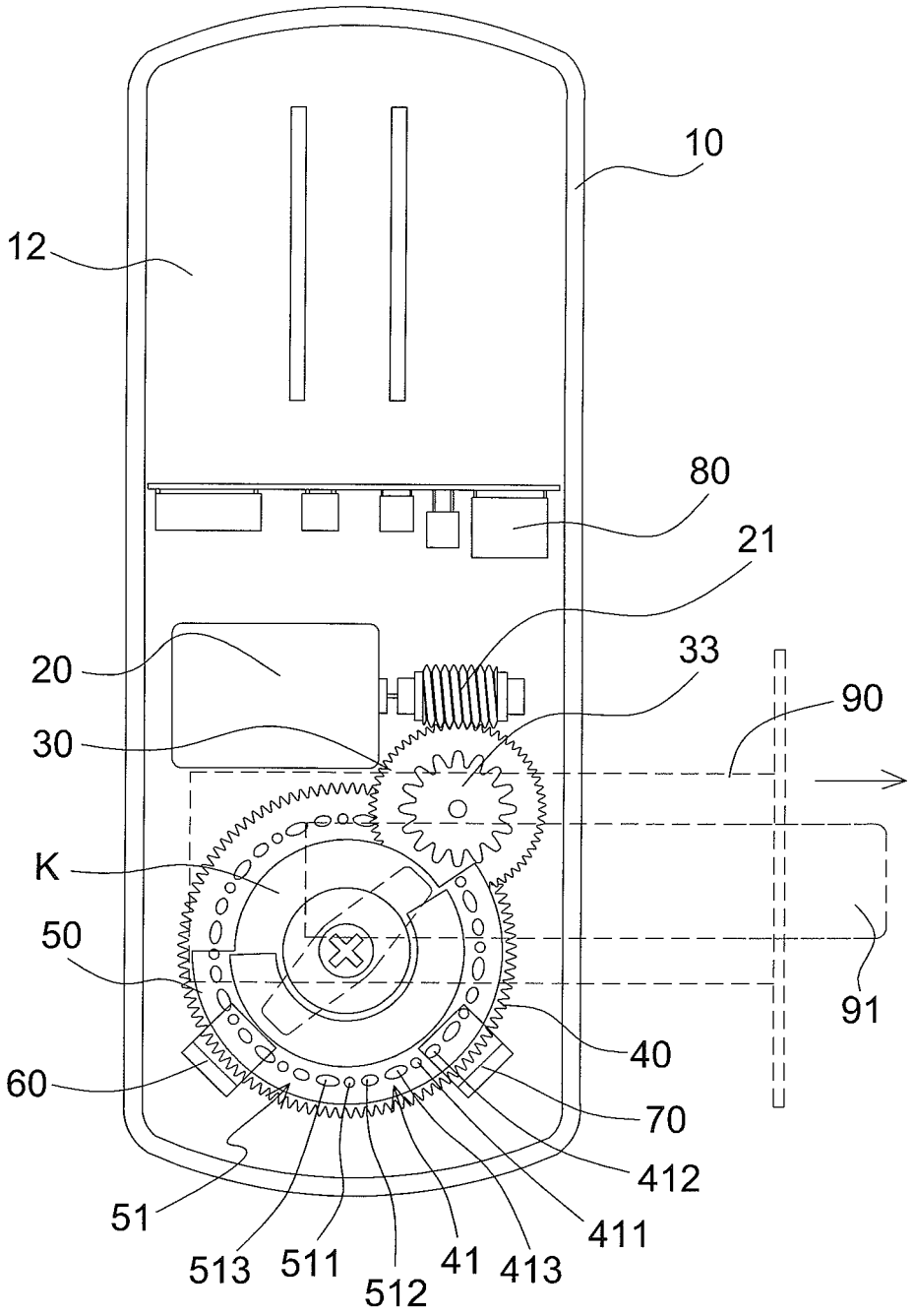
FIG. 4 is another plan view showing the application of the electronic look according to the preferred embodiment of the present invention.

With reference to FIGS. 1-4, an electronic lock according to a preferred embodiment of the present invention comprises:

a housing 10 including an accommodating chamber 11, and the accommodating chamber 11 having a central controlling unit 80 disposed at a first predetermined position thereof and being adjacent to a power supply 12, the accommodating chamber 11 also having a first connecting member 17 and a second connecting member 18 mounted on a third predetermined position and a fourth predetermined position thereof, wherein the first connecting member 17 has at least one first hole 171, the second connecting member 18 has at least one second hole 181, and a guiding member 15 is fixed in the accommodating chamber 11 proximate to the first connecting member 17 and the second connecting member 18 and has an orifice 16 defined at a central position thereof, a shaft 14 is secured in the accommodating chamber 11 adjacent to the guiding member 15, a motor mount 13 is disposed in the accommodating chamber 11 proximate to the shaft 14;

a driving motor 20 fixed in the motor mount 13 of the housing and including a threaded rod 21 mounted on one end thereof;

a driving gear 30 including a through aperture 31 formed at a central position thereof, a plurality of first teeth 32 arranged around an outer rim thereof, a toothed block 33 secured at a central position of a bottom end thereof, wherein the through aperture 31 fits with the shaft 14 of the housing 10, and the plurality of first teeth 32 are driven by the threaded rod 21 of the driving motor 20;

a first driven gear 40 including a first opening 43 and a first detected portion 41, wherein the first opening 43 and the orifice 16 are located in the guiding member 15 of the housing 10, and the first detected portion 41 has a plurality of transparent zones of varying diameter and width successively arranged around an end surface of the first driven gear 40 which meshes with the toothed block 33 of the driving gear 30; wherein the plurality of transparent zones of varying diameter and width of the first detected portion 41 contains plural first transparent zones 411, plural second transparent zones 412 and plural third transparent zones 413;

a second driven gear 50 including a second opening 52 and a second detected portion 51, wherein the second opening 52 is fixed in an upper section of the guiding member 15 of the housing 10, and the second detected portion 51 has a plurality of transparent zones of varying diameter and width successively arranged around an end surface of the second driven gear 50; wherein the plurality of transparent zones of the second detected portion 51 contains plural fourth transparent zones 511, plural fifth transparent zones 512, and plural sixth transparent zones 513;

a first photo interrupter 60 including a first seat 61, a first light transmitting portion 62 and a first light receiving portion 63 which extend outwardly from two sides of the first seat 61, a first transistor 65 connecting with one side of the first seat 61 and having a first transmission line 66 which couples with the central controlling unit 80, and the first photo interrupter 60 also including at least two first coupling pins 64 secured on at least two predetermined positions thereof, and the at least two first coupling pins 64 being positioned in the at least one first hole 171 of the housing 10 so that the first light transmitting portion 62 and the first light receiving portion 63 are aligned with the second detected portion 51 of the second driven gear 50;

a second photo interrupter 70 including a second seat 71, a second light transmitting portion 72 and a second light receiving portion 73 which extend outwardly from two sides of the second seat 71, a second transistor 75 connecting with one side of the second seat 71 and having a second transmission line 76 which couples with the central controlling unit 80, and the second photo interrupter 70 also including at least two second coupling pins 74 secured on at least two predetermined positions thereof, and the at least two second coupling pins 74 being positioned in the at least one second hole 181 of the housing 10 so that the second light transmitting portion 72 and the second light receiving portion 73 are aligned with the first detected portion 41 of the first driven gear 40;

a rotary knob K including a grip portion K1, an stem K2 extending outwardly from the grip portion K1, and a cross pore K3 defined on a distal end of the stem K2 such that the stem K2 of the rotary knob K inserts and rotates into the first opening 43 and the orifice 16 of the housing 10 so that the grip portion K1 stops an outer wall of the housing 10; wherein the cross pore K3 of the rotary knob K controls a locking head 91 of a latch 90 in a multi-section controlling manner.

In operation, the locking head 91 is unlocked in a remote control mode, and the central controlling unit 80 controls the driving motor 20 to drive the driving gear 30, then the driving gear 30 meshes with and drives the first driven gear 40 and the second driven gear 50 to rotate, such that the first driven gear 40 and the second driven gear 50 drive the stem K2 to rotate in the multi-section controlling manner, thus unlocking the locking head 91 (i.e., in a retracting state). When the first driven gear 40 and the second driven gear 50 rotate, the first light transmitting portion 62 and the first light receiving portion 63 of the first photo interrupter 60 optically scan the plural fourth transparent zones 511, the plural fifth transparent zones 512, and the plural sixth transparent zones 513 which form the plurality of transparent zones of varying diameter and width successively arranged around the end surface of the first driven gear 40 so that the first transistor 65 of the first photo interrupter 60 accurately judges a rotating position of the second driven gear 50, and the first photo interrupter 60 transmits a signal to the central controlling unit 80 via the first transmission line 66, hence the central controlling unit 80 controls the driving motor 20 to drive the second driven gear 50, and the second driven gear 50 axially rotates to compensate a unreached distance of the second driven gear 50 to a second destination position, then the locking head 91 reversely rotates. On the contrary, when the locking head 91 is locked in the remote control mode, and the central controlling unit 80 controls the driving motor 20 to drive the driving gear 30, then the driving gear 30 meshes with and drives the first driven gear 40 and the second driven gear 50 to rotate reversely, such that the first driven gear 40 and the second driven gear 50 drive the stem K2 to rotate in the multi-section controlling manner, thus locking the locking head 91 (i.e., in an extending state). When the first driven gear 40 and the second driven gear 50 rotate, the second light transmitting portion 72 and the second light receiving portion 73 of the second photo interrupter 70 optically scan the plural first transparent zones 411, the plural second transparent zones 412, and the plural third transparent zones 413 which form the plurality of transparent zones of varying diameter and width successively arranged around the end surface of the first driven gear 40 so that the second transistor 75 of the second photo interrupter 70 accurately judges a rotating position of the first driven gear 40, and the second photo interrupter 70 transmits a signal to the central controlling unit 80 via the second transmission line 76, hence the central controlling unit 80 controls the driving motor 20 to drive the second driven gear 50, and the first driven gear 40 axially rotates to compensate an unreached distance of the first driven gear 40 to a first destination position, then the locking head 91 rotates forward.

Thereby, the first light transmitting portion and the first light receiving portion of the first photo interrupter optically scan the plural fourth transparent zones, the plural fifth transparent zones and the plural sixth transparent zones which form the plurality of transparent zones of varying diameter and width successively arranged around the end surface of the first driven gear so that the first transistor of the first photo interrupter accurately judges the rotating position of the second driven gear, and the second light transmitting portion and the second light receiving portion of the second photo interrupter optically scan the plural first transparent zones, the plural second transparent zones, and the plural third transparent zones which form the plurality of transparent zones of varying diameter and width successively around the end surface of the first driven gear so that the second transistor of the second photo interrupter accurately judges the rotating position of the first driven gear. Thereby, the central controlling unit controls the first driven gear and the second driven gear to axially rotate so as to compensate unreached distances of the first driven gear and the second driven gear to the first destination position and the second destination position, hence the locking head rotates forward and reversely.

While we have shown and described various embodiments in accordance with the present invention, it is clear to those skilled in the art that further embodiments may be made without departing from the scope of the present invention.

What is claimed is:

1. An electronic lock comprising:

a housing including an accommodating chamber, and the accommodating chamber having a central controlling unit disposed at a first predetermined position thereof and being adjacent to a power supply, the accommodating chamber also having a first connecting member and a second connecting member mounted on a third predetermined position and a fourth predetermined position thereof, wherein the first connecting member has at least one first hole, the second connecting member has at least one second hole, and a guiding member is fixed in the accommodating chamber proximate to the first connecting member and the second connecting member and has an orifice defined at a central position thereof, a shaft is secured in the accommodating chamber adjacent to the guiding member, and a motor mount is disposed in the accommodating chamber proximate to the shaft;

a driving motor fixed in the motor mount of the housing and including a threaded rod mounted on one end thereof;

a driving gear including a through aperture formed at a central position thereof, a plurality of first teeth arranged around an outer rim thereof, and a toothed block secured at a central position of a bottom end thereof, wherein the through aperture fits with the shaft of the housing, and the plurality of first teeth are driven by the threaded rod of the driving motor;

a first driven gear including a first opening and a first detected portion, wherein the first opening and the orifice are located in the guiding member of the housing, and the first detected portion has a plurality of transparent zones of varying diameter and width successively arranged around an end surface of the first driven gear which meshes with the toothed block of the driving gear;

a second driven gear including a second opening and a second detected portion, wherein the second opening is fixed in an upper section of the guiding member of the housing, and the second detected portion has a plurality of transparent zones of varying diameter and width successively arranged around an end surface of the second driven gear;

a first photo interrupter including a first seat, a first light transmitting portion and a first light receiving portion which extend outwardly from two sides of the first seat, a first transistor connecting with one side of the first seat and having a first transmission line which couples with the central controlling unit, and the first photo interrupter also including at least two first coupling pins secured on at least two predetermined positions thereof, and the at least two first coupling pins being positioned in the at least one first hole of the housing so that the first light transmitting portion and the first light receiving portion are aligned with the second detected portion of the second driven gear;

a second photo interrupter including a second seat, a second light transmitting portion and a second light receiving portion which extend outwardly from two sides of the second seat, a second transistor connecting with one side of the second seat and having a second transmission line which couples with the central controlling unit, and the second photo interrupter also including at least two second coupling pins secured on at least two predetermined positions thereof, and the at least two second coupling pins being positioned in the at least one second hole of the housing so that the second light transmitting portion and the second light receiving portion are aligned with the first detected portion of the first driven gear;

a rotary knob including a grip portion, an stem extending outwardly from the grip portion, and a cross pore defined on a distal end of the stem such that the stem of the rotary knob inserts and rotates into the first opening and the orifice of the housing so that the grip portion stops an outer wall of the housing.

2. The electronic lock as claimed in claim 1, wherein the plurality of transparent zones of the first detected portion contain plural first transparent zones, plural second transparent zones, and plural third transparent zones.

3. The electronic lock as claimed in claim 1, wherein the plurality of transparent zones of the second detected portion contain plural fourth transparent zones, plural fifth transparent zones, and plural sixth transparent zones.

4. The electronic lock as claimed in claim 1, wherein the cross pore of the rotary knob controls a locking head of a latch in a multi-section controlling manner.

* * * * *